US009096344B1

(12) United States Patent
Block

(10) Patent No.: US 9,096,344 B1
(45) Date of Patent: Aug. 4, 2015

(54) CARTON WITH CORNER DISPENSER

(71) Applicant: The C.W. Zumbiel Company, Hebron, KY (US)

(72) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 154 days.

(21) Appl. No.: 13/783,440

(22) Filed: Mar. 4, 2013

Related U.S. Application Data

(60) Provisional application No. 61/607,116, filed on Mar. 6, 2012, provisional application No. 61/638,571, filed on Apr. 26, 2012.

(51) Int. Cl.
*B65D 5/72* (2006.01)
*B65D 5/54* (2006.01)

(52) U.S. Cl.
CPC . *B65D 5/542* (2013.01); *B65D 5/72* (2013.01)

(58) Field of Classification Search
USPC ..... 229/122–122.1, 242, 302, 305; 206/427
See application file for complete search history.

(56) References Cited

U.S. PATENT DOCUMENTS

| | | | | | |
|---|---|---|---|---|---|
| 2,385,400 | A | | 9/1945 | Briggs | |
| 2,751,075 | A | | 6/1956 | Arneson | |
| 2,754,047 | A | | 7/1956 | Schmidt et al. | |
| 3,071,306 | A | | 1/1963 | Trethewey | |
| 3,265,283 | A | | 8/1966 | Farquhar | |
| 3,300,115 | A | | 1/1967 | Schauer | |
| 3,346,167 | A | * | 10/1967 | Schmidt | 229/117.15 |
| 3,356,279 | A | | 12/1967 | Root | |
| 3,409,183 | A | * | 11/1968 | Gish | 221/308 |
| 3,517,858 | A | | 6/1970 | Farquhar | |
| 3,519,194 | A | | 7/1970 | Kohlhaas et al. | |
| 3,721,382 | A | | 3/1973 | Cavanagh et al. | |
| 3,807,624 | A | | 4/1974 | Funkhouser | |
| 3,894,681 | A | | 7/1975 | Arneson et al. | |
| 4,030,661 | A | | 6/1977 | Farquhar | |
| 4,058,354 | A | | 11/1977 | Powaska | |
| 4,155,449 | A | | 5/1979 | Bryne | |
| 4,163,508 | A | * | 8/1979 | Mannor | 221/310 |
| 4,214,660 | A | | 7/1980 | Hunt, Jr. | |
| 4,216,861 | A | | 8/1980 | Oliff | |
| 4,318,474 | A | | 3/1982 | Hasegawa | |
| 4,364,509 | A | | 12/1982 | Holley, Jr. et al. | |
| 4,378,877 | A | | 4/1983 | Botterman et al. | |
| 4,396,143 | A | | 8/1983 | Killy | |
| 4,398,636 | A | | 8/1983 | Baxter | |
| 4,497,433 | A | | 2/1985 | Wischusen, III | |
| 4,605,128 | A | | 8/1986 | Rieke | |
| 5,106,014 | A | | 4/1992 | Miller | |
| 5,249,681 | A | | 10/1993 | Miller | |
| 6,578,736 | B2 | | 6/2003 | Spivey | |
| 6,604,677 | B1 | | 8/2003 | Sutherland et al. | |
| 6,869,009 | B2 | | 3/2005 | Sutherland et al. | |
| 7,134,551 | B2 | | 11/2006 | Harrelson | |
| 7,331,507 | B2 | | 2/2008 | Sutherland et al. | |
| 7,874,477 | B2 | | 1/2011 | Sutherland et al. | |

* cited by examiner

*Primary Examiner* — Christopher Demeree
*Assistant Examiner* — Phillip Schmidt
(74) *Attorney, Agent, or Firm* — Wood, Herron & Evans, LLP

(57) ABSTRACT

A dispenser is for removal of containers, e.g., beverage and non-beverage containers, held in a matrix configuration within a carton. A dispenser opening is defined in the carton's top panel with the dispenser opening being oriented on a single longitudinal axis oriented normal to the top panel. The dispenser opening is sized to allow egress of each container in the container matrix. Retaining flaps are included with the dispenser to inhibit unintended egress of the containers. A push hole may be provided in the carton opposite from the dispenser to allow access by a user to push the container out of the dispenser.

21 Claims, 8 Drawing Sheets

CARTON WITH CORNER DISPENSER

This claims priority to U.S. Provisional Application Ser. Nos. 61/638,571, filed Apr. 26, 2012, and 61/607,116, filed Mar. 6, 2012, each of which is hereby incorporated by reference in its entirety.

BACKGROUND OF THE INVENTION

This invention relates to cartons. More particularly, this invention relates to a dispenser system for beverage and non-beverage container cartons.

Packages or cartons particularly adapted for use with containers, e.g., cans or bottles, are very well known to the prior art in the marketing of beer, soft drinks and non-beverage items. The typical carton packages a series of containers in a 2×3, 2×6, 3×4 matrix or other configuration, and is fabricated from paperboard. Often such cartons are sized to hold six, eight or twelve or even twenty-four containers for purchase by the retail consumer at grocery stores or specialty markets. Such paperboard container cartons or packages have seen widespread commercial success in the marketplace.

Fully enclosed cartons capable of enclosing containers have been used in the past and include a feature for dispensing the containers one at a time. Dispensers have been provided at various locations on these cartons depending on the design. Many of these dispensers suffer from the disadvantage that once open, they allow all of the containers to roll out. In addition, it is difficult to carry one of these cartons without the containers falling out once the dispenser has been opened. Many of these dispensers have been designed for dispensing cans or bottles which have cylindrical shapes with tops and bottoms of substantially the same size and configuration.

In effect, many of these dispensers destroy the overall carton integrity once they have been opened. Many of these dispensers do not have any means for the easy opening of the dispenser for dispensing the containers inside the carton one at a time. Furthermore, many dispensers are not set up so that the containers inside the carton roll into position for dispensing once a previous container has been removed from the carton.

A basic carton dispenser system is defined by one or more of the carton's paperboard walls, and includes a flap tear out structure of some kind or another which opens the carton only partially so that one or more, but not all, the containers may be removed in sequence as desired by the end user. One specific type of prior art carton dispenser system, and one that has seen widespread commercial use in the marketplace, is that which allows the beverage containers to be drawn out from a top or bottom forward corner of the container carton when it is stored in a refrigerator. This prior art dispenser system involves a tear out mouth in the front top or bottom corner of the container carton which extends across the width of the carton's forward end wall, and which allows the beverage container to be gripped by a user's fingers so that it can be drawn out of the carton's mouth.

The prior art dispenser systems have several disadvantages. First, and as noted, when the first container of a carton is removed from the carton's transverse mouth there is a substantial weight which bears on the next container that rolls forward for removal. And sometimes, other containers will unintentionally roll out after a first container has been removed. When subsequent containers roll out on their own against the user's desire, some may fall to the floor which could cause a safety problem. But in any event, whatever containers undesirably roll out must be returned to the carton or to the storage location, e.g., the refrigerator, with the accompanying frustration or displeasure that such an event causes.

Second, once the carton dispenser system is opened with a carton dispenser system of the transverse mouth type as described above, the closure integrity of the carton is immediately destroyed. In other words, and once the carton's transverse mouth has been opened, from a realistic standpoint it may be no longer possible to carry the carton with full containers therein by whatever handle structure is provided on the carton. This for the simple reason that in carrying the open mouth carton, the full beverage containers remaining therein may roll out the open mouth against the user's desire.

And thirdly, with a prior art carton having the transverse end mouth dispenser system as described above, the carton can be oriented only on its bottom wall in order to withdraw full containers through the carton's discharge mouth. Such prior art cartons often are of rectangular configuration, and it may be desirable to stand the carton on its end wall (which is normally of lesser length than its bottom wall) in order to save space in the environment such as a refrigerator, within which the carton is stored. But this is not possible with the prior art cartons because the opened transverse mouth would not be readily accessible to the carton's user, and containers could not be readily withdrawn therefrom if the prior art carton was stood on that end wall within which the transverse mouth was defined.

Accordingly, it has been one objective of this invention has been to provide a carton dispenser system particularly adapted for use with beverage and non-beverage containers that allows individual containers within the carton's container matrix stored to be withdrawn from that carton one at a time through a dispenser opening which maintains the structural integrity of the carton.

Another objective of this invention has been to provide a carton dispenser system particularly adapted for use with containers which may not have a pronounced crown or tapered edge such as is commonly provided on beverage containers. The dispenser allowing individual containers within the carton's container matrix stored to be withdrawn from that carton one at a time through a dispenser opening which maintains the structural integrity of the carton.

SUMMARY OF THE INVENTION

In accord with these and other objectives, this invention is directed in various embodiments to a carton adapted to hold a number of containers, e.g., beverage cans or bottles, pet food and other items, the longitudinal axis of each container being oriented parallel to the longitudinal axis of every other container in a container matrix. The carton includes opposed parallel top and bottom panels, the container axes being oriented normal to those panels in the final package. A dispenser or dispenser opening is defined in the carton's top panel, the dispenser opening being oriented on a single longitudinal axis with a container in a corner of the matrix in the carton and normal to the carton's top panel. The dispenser opening is sized to allow egress of each container in the container matrix out of the carton's top panel. In one embodiment, the dispenser opening is located proximate to a corner of the carton, but does not include the carton corner or adjacent edges to maintain carton integrity after the dispenser is opened. Also, a dispenser flap removably closes the dispenser opening. The dispenser flap is at least partially defined by cut lines formed in the top panel and is removable by a user when removal of the containers from the carton is desired.

A carton with a dispenser in accord with this invention provides several distinct and advantageous features relative to the prior art. First, and when a carton filled with containers is first opened by the user, neither the first container nor any successive container in the carton container inadvertently rolls or falls out of the carton as long as it is stored on its bottom wall. Second, when the carton is carried by a handle structure defined in the carton's side panel, again no container in the carton will fall or roll out of the carton as long as the carton's side walls are maintained generally parallel relative to the ground. And third, the carton may be stored either in a refrigerator or elsewhere, by standing it on its end wall or by standing it on its bottom wall in order to maximize space efficiency in the storage environment as desired by the user, and whether stored on either an end panel, side panel or the bottom panel the containers will remain in the carton until they easily removed therefrom by a user.

Briefly described, in one form, the objects of this invention are achieved by providing an enclosed carton that has a unique dispenser or opening in a corner of the top panel of the carton. This carton is generally rectangular and has a bottom, top, two sides, and two ends. The carton is foldably constructed from a blank having panels and flaps. The dispenser or opening is formed in one of the corners on the top panel of the carton by providing a tear line between the dispenser flap and the top panel that is resistant to tearing. A finger pull tab is attached to the dispenser flap with the pull tab being loosely attached to the carton for easy detachment so that it can be used for pulling the dispenser flap open. Since the containers designed to be carried by this carton are cylindrical, the dispenser flap needs to be generally circular. It may be truncated at the adjacent corner of the top panel by placing the tear line for the dispenser flap a distance from the corner.

In one aspect of this invention, a push hole is provided on the carton opposite from the dispenser to allow access to an opposite end of the container positioned adjacent the dispenser so that a user can push the container into and out of the dispenser opening opposite from the push hole in the carton.

In another aspect of various embodiments of this invention, the dispenser opening does not include the carton corner or either of the fold lines adjacent to the carton corner. Such an arrangement provides for a more robust carton once the dispenser is opened and maintains the accessibility of the remaining containers in the carton for subsequent removal as desired.

The dispenser flap on this carton is removed entirely from the carton to expose the dispenser opening. Once the dispenser flap has been removed by pulling on the pull tab, a person may remove a container by reaching into the dispenser opening and pulling a container through the dispenser opening. Other containers roll towards the dispenser opening after the removal of the prior container. It may be necessary to place the dispenser opening in the top panel as the containers with smaller necks and bodies should be stacked in the carton in an upright position to prevent spillage and damage. The removal of these containers is facilitated by virtue of the small diameter of the neck of the bottle being located near the top panel where the dispenser opening is located. Another embodiment includes a push hole to assist in the initial removal of the container.

The dispenser opening can be constructed by providing a tear line defining the dispenser flap which forms an opening for removing containers when opened. The dispenser flap is truncated at the adjacent corner of the top panel and the dispenser flap can be easily removed and the structural integrity of the carton maintained.

One feature of this invention in various embodiments is one or more retainer flaps each positioned to partially cover the dispenser opening. The retainer flaps act as a brake or detent so that only one container at a time is removed as desired, the retainer flaps inhibiting those containers that remain in the carton from rolling out of the carton in response to the push out forces exerted by the weight of the containers remaining in the carton.

This carton can be constructed by gluing, taping, stapling and the like, or by locking. It may have handles in the side panel for carrying so that the containers are carried in an upright position to help minimize damage to the carton or the containers contained therein.

These and other objects, features, and advantages of this invention will become more apparent upon reading the following specification in conjunction with the accompanying drawing figures.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
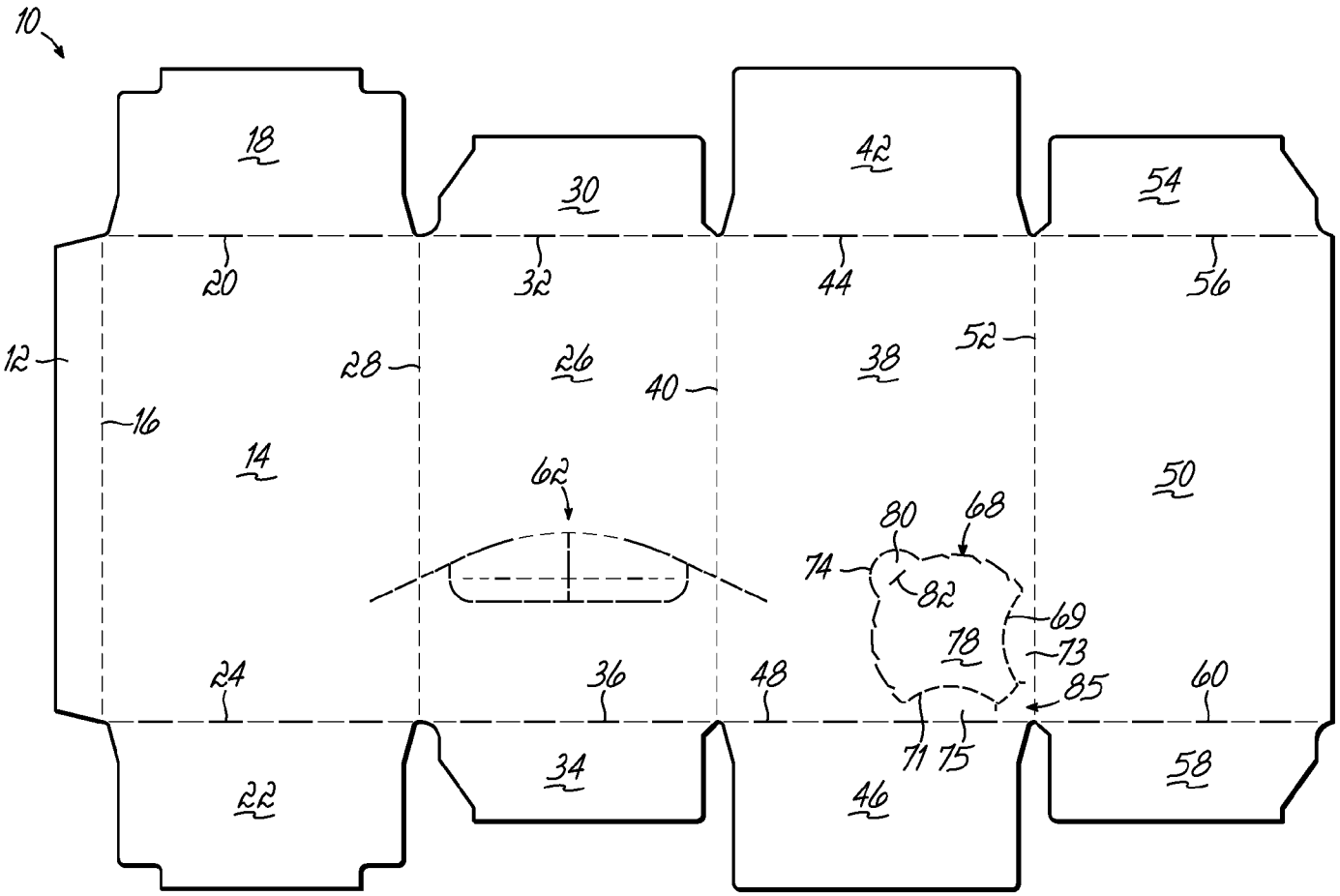
FIG. 1 is a top plan view of a carton blank from which a container can be formed into a carton according to one embodiment of this invention.
Figure 2:
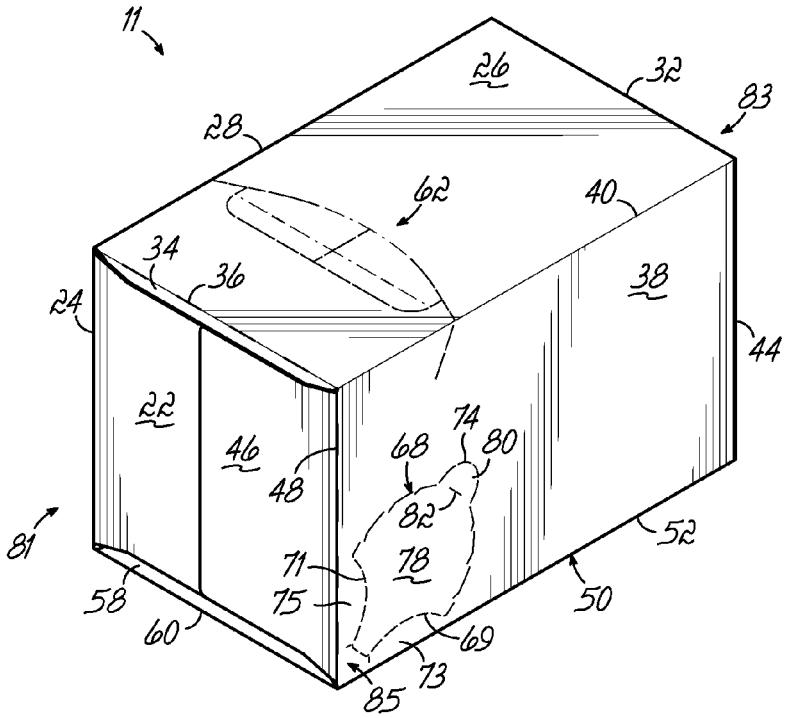
FIG. 2 is a perspective view of a carton formed from the carton blank of FIG. 1.

One embodiment of this invention is intended primarily for use with containers, bottles or cans that have a beverage therein and have a generally cylindrical shape. Referring to FIG. 1, a blank 10 is used to erect a carton 11 and is formed from a foldable sheet material, such as paperboard. The blank 10 has a glue flap 12 which is attached to a bottom panel 14 by fold line 16. Bottom end flaps 18 and 22 are attached to a bottom panel 14 by fold lines 20 and 24, respectively. Bottom panel 14 is attached to a side panel 26 by a fold line 28. Side panel 26 is attached to side end flaps 30 and 34 by fold lines 32 and 36, respectively. Side panel 26 is attached to a top panel 38 by a fold line 40. Top panel 38 is attached to top end flaps 42 and 46 by fold lines 44 and 48, respectively. Side panel 50 is attached to a top panel 38 by a fold line 52. Side panel 50 is attached to side end flaps 54 and 58 by fold lines 56 and 60, respectively. The carton may be provided with a handle 62 formed in side panel 26 and in one embodiment the handle is according to U.S. Pat. No. 5,106,014, which patent is hereby incorporated by reference in its entirety.

Figure 3:
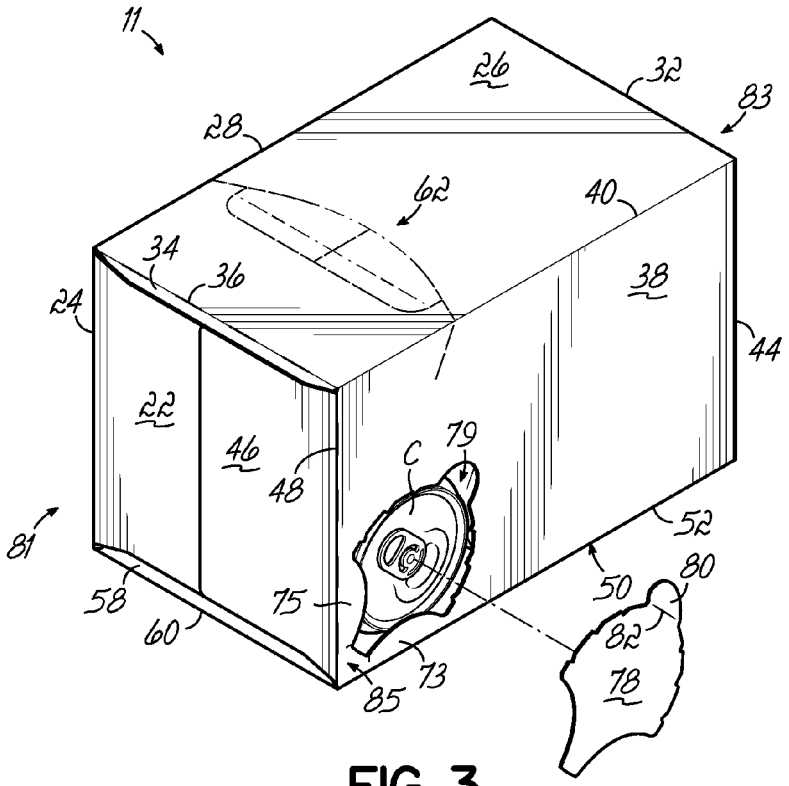
FIG. 3 is a view similar to FIG. 2 with a dispenser flap removed from a panel of the carton to expose a dispenser opening in the carton panel.
Figure 4:
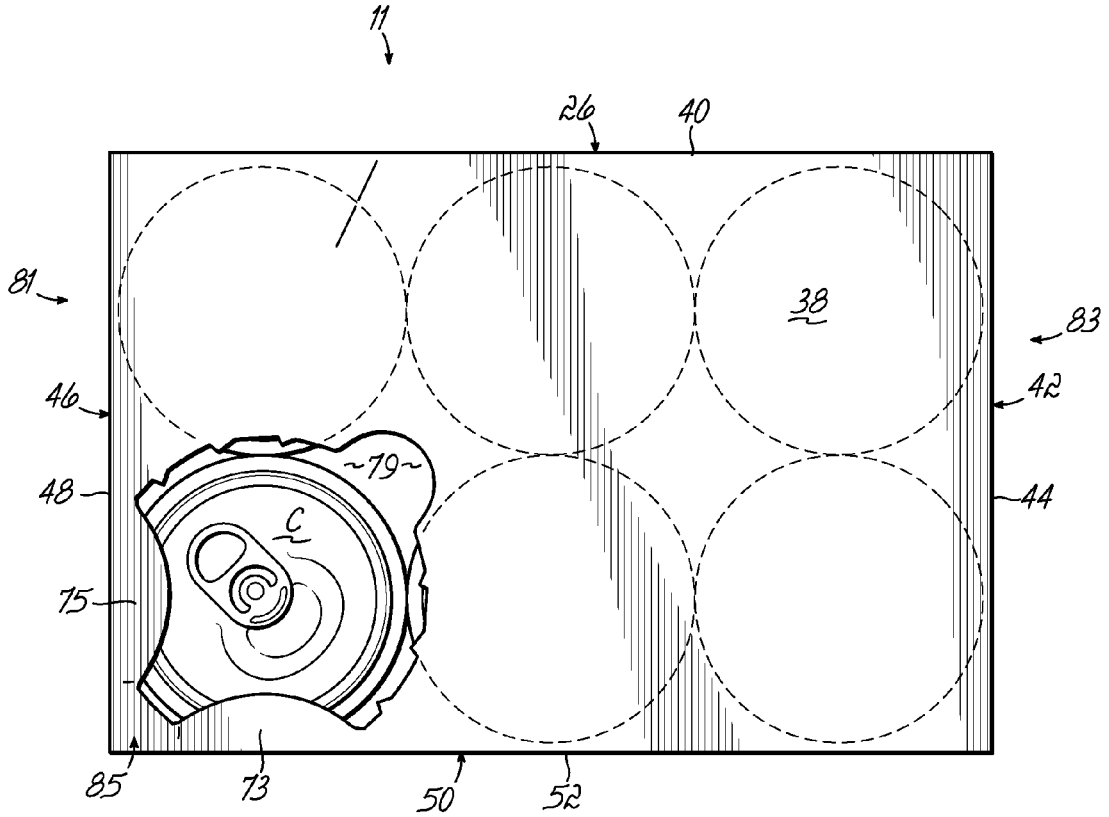
FIG. 4 is a side elevational view of the carton of FIGS. 2-3 with the dispenser flap removed and the containers arranged in the carton.
Figure 5:
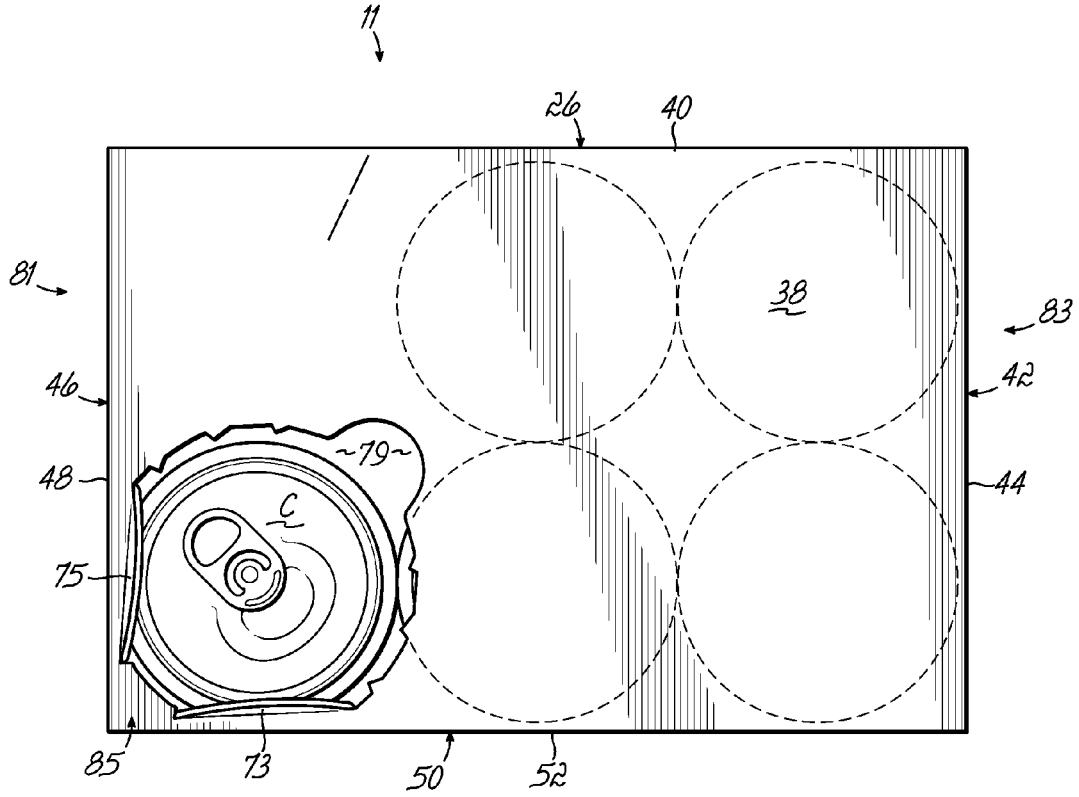
FIG. 5 is a view similar to FIG. 4 after one of the containers has been removed from the carton through the dispenser opening and retaining flaps extending at least partially into the dispenser opening according to one aspect of this invention.

A tear line 68 is provided in the top panel 38, with the tear line 68 not extending along fold line 52 or along fold line 48. Tear line 68 defines and tightly connects a dispenser flap 78 to the top panel 38. A pull tab 80 is connected to the dispenser flap 78 by a fold line 82. The pull tab 80 is loosely attached to the top panel 38 by tear line portion 74. The dispenser flap when attached to the top panel of the carton covers a dispenser opening 79. The dispenser flap 78 and dispenser opening 79 have a generally circular configuration with the exception of the pull tab 82 and a pair of arcuate tear line portions 69, 71. The arcuate tear line portions 69, 71 are each positioned relative to one of the fold lines 48, 52 forming the corner 85 proximate to the location of the dispenser opening 79 in the top panel 38 of the carton 11. In one embodiment, the tear line 68 which defines the dispenser flap 78 and dispenser opening 78 is spaced from the adjacent fold lines 48, 52 and no portion of the tear line 68 intersects or is coincident with the fold lines 48, 52 according to one embodiment of this invention. The arcuate tear line portions 69, 71 each define a retaining flap 73, 75 which extends into the dispenser opening 79 once the dispenser flap 78 is removed from the top panel 38 of the carton 11. As shown in FIGS. 3-5, the retaining flaps 73, 75 assist in retaining the container C positioned for removal from the carton 11 through the dispenser opening 79 until such time as a user extracts the container C through the dispenser opening 79. The retaining flaps 73, 75 initially project into the dispenser opening 79 and after removal of the container C, the retaining flaps 73, 75 may be partially deflected so that they are neither parallel nor perpendicular to the plane of the top panel 38 of the carton 11 thereby at least partially occluding the dispenser opening 79 to inhibit accidental removal or discharge of a container C from the carton 11 through the dispenser opening 79. The corner portion 85 of the top panel 38 remains after the dispenser flap 78 is removed and is generally positioned adjacent to the retaining flaps 73, 75 as shown in FIGS. 1-5. The corner portion 85 provides added structural integrity to the carton even with the dispensing flap 78 removed.

In forming this blank 10 into a carton 11, the blank 10 is formed into a sleeve with the glue flap 12 being glued to the side panel 50. Containers C having a top portion can be loaded into the carton 11 with their top ends being adjacent to the top panel 38. The various end flaps 18, 22, 30, 34, 42, 46, 54, and 58 can be glued together to form the respective ends 81, 83 of the carton 11 and finish the erection of the loaded carton 11. It should be realized that this carton sleeve could be held together by locks rather than glue.

Containers C automatically roll into position for being dispensed by placing the carton 11 on the end 81 adjacent to the dispenser opening 79 or on the side 50 as illustrated in FIG. 3. The dispenser flap 78 can be opened or removed while the carton 11 is resting on the side panel 50 or as shown in FIG. 3 or when it has been placed on the end 81 adjacent to the dispenser flap 78. The dispenser flap 78 is removed by pushing pull tab 80 in and pulling out the pull tab 80. The dispensing flap 78 can be easily detached from the top panel 38 because of the tear line 68.

A container C can then be removed through the resulting dispenser opening 79 by grasping the container C and pulling it along its longitudinal axis until it is removed from the carton 11. Another container C will then drop into place for removal through the dispenser opening. It will be observed that the containers C are placed in the carton 11 with their longitudinal axes normal to top panel 38 and bottom panel 14 with the tops of the containers C being adjacent to the top panel 38 in one embodiment.

It will be noticed that the dispenser flap 78 and dispenser opening 79 are basically circular, but are truncated where tear line 68 approaches fold lines 48, 52 and where it approaches corner 85 of the carton where fold lines 48, 52 intersect. Tear line 68 may be interrupted by fold line 82 connecting dispenser flap 78 with pull tab 80 which facilitates the pull tab exerting the leverage on the dispenser flap 78 for ease of removal.

It should be realized that the dispenser 78 can be located in any corner of the top panel 38 and dispensers could be located in more than one location in the top panel 38. In one embodiment, there is only one dispenser in order to preserve the integrity of the carton 11.

The dispenser flap 78 of this invention is resistant to accidental tearing by the weight of the adjacent container C by the provision of resistant tear line 68 connecting the dispenser flap 78 to the top panel 38 of the carton 11. The pull tab 80 that is loosely connected to the top panel 38 of the carton 11 has been provided so that it can be easily partially detached and provide the necessary leverage to remove the dispenser flap 78. The connection of the dispenser flap 78 can be constructed so the flap 78 can be completely removed.

Because the dispenser of this invention is located in the top panel, the dispenser flap can be easily removed for dispensing containers, but yet carried in its upright position by the handle without danger of the containers falling out of the carton.

The carton 11, with the container matrix suitably enclosed therein, is distributed from beverage bottlers through retail outlets to retail consumers the dispenser 78 closed, i.e., with the dispenser flap integral with and not removed from the top panel 38. After purchase at a retail outlet, and in order to take the filled beverage package or carton 11 home, the retail consumer can break away the carton's handle structure 62 so that the carton 11 can be carried by that handle structure. But the dispenser opening flap 78 is not removed from the carton 11 until use of the beverage containers C stored within the carton 11 is desired by the retail customer.

When use of the beverage containers C is desired, and as shown in FIGS. 2-5, the carton 11 may be stored on a shelf in a refrigerator or pantry. In order to remove the containers C one by one from the carton 11, the dispenser opening flap 78 is removed or torn away from the carton's top panel 38. With the carton 11 stored on its side panel 50 as shown in FIG. 3.

Containers C can be easily removed from the carton 11 while it is stored in that posture because the carton's dispenser opening 79 is located at the carton's corner 85. On the other hand, the carton 11 also can be stored on its end 81 with the containers C being easily removed from the carton 11 because in this storage position the carton's dispenser opening 79 is also located at the front edge.

Note particularly as illustrated in FIG. 5, that with the dispenser opening 79 open the carton 11 can be easily carried without the containers C remaining in the carton 11 falling out of the carton 11 as long as the carton's top and bottom panels 38, 14 are maintained generally perpendicular relative to ground. In other words, the structural integrity of the carton 11 is maintained at all of its four corners and particularly at that corner 85 from which the individual containers C are withdrawn as desired, because of the structural integrity of the corner 85 defined between the carton's adjacent panels.

Another embodiment of this invention is shown in FIGS. 6-10 and is intended primarily for use with non-beverage containers, such as pet food or another product. Many containers or cans C have a generally cylindrical shape, but do not have a pronounced crown or tapered edge at the transition from the top or bottom of the container to the arcuate sidewall of the container. Due to the lack of a crown, such containers may be more difficult for users to grasp and pull from the container through the dispenser. Features and components of the embodiment shown in FIGS. 6-10 which are the same or similar to corresponding features in the embodiment of FIGS. 1-5 are identified by like reference numerals in the 100 series of numerals.

Figure 6:
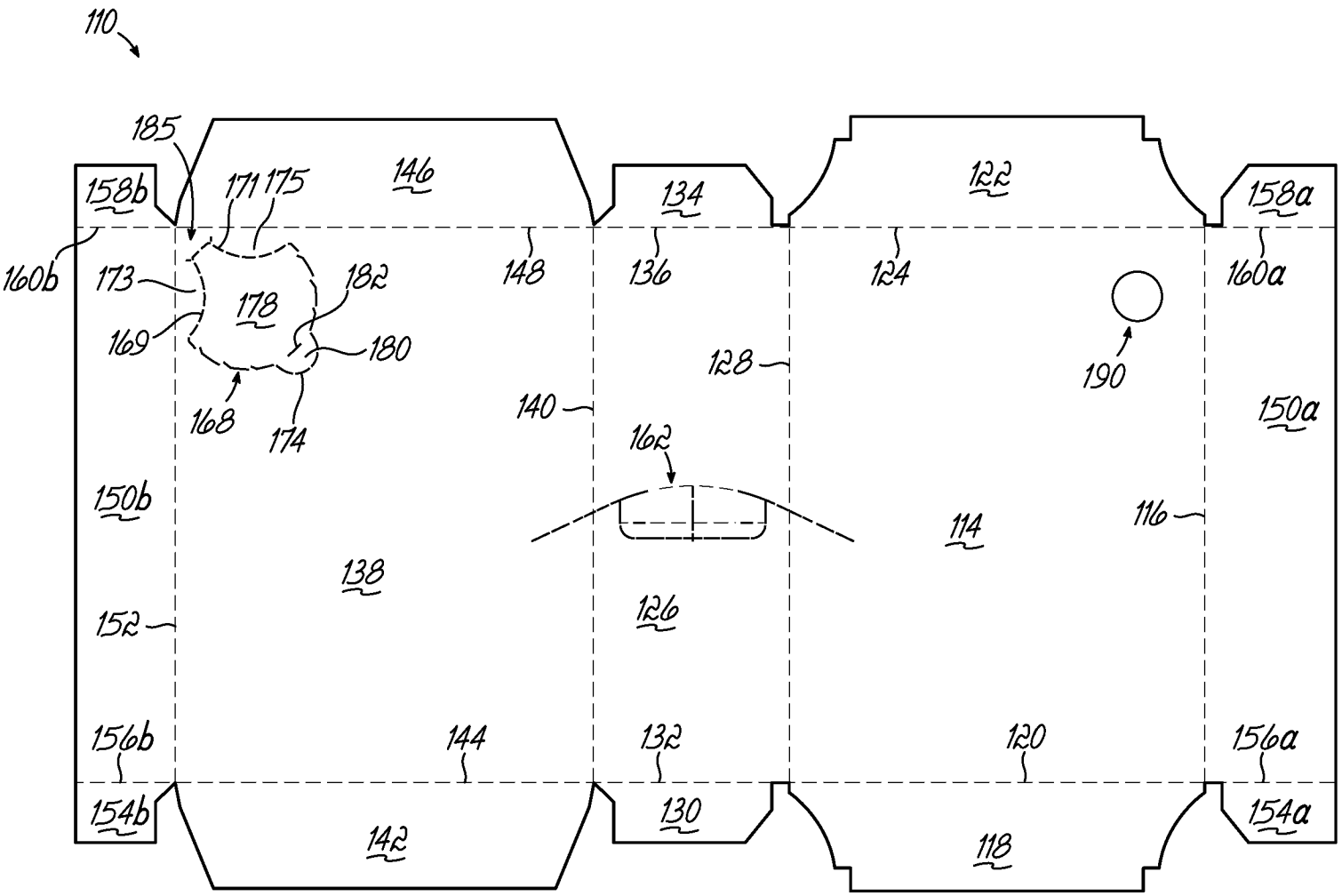
FIG. 6 is a top plan view of a carton blank from which a container may be formed into a carton according to another embodiment of this invention.

Referring to FIG. 6, a blank no is used to erect a carton 111 and is formed from a foldable sheet material, such as paperboard. The carton 111 has a side panel formed from two overlapping side panel portions 150*a*, 150*b* and portion 150*a* is attached to a bottom panel 114 by fold line 116. Bottom end flaps 118 and 122 are attached to a bottom panel 114 by fold lines 120 and 124, respectively. Bottom panel 114 is attached to a side panel 126 by a fold line 128. Side panel 126 is attached to side end flaps 130 and 134 by fold lines 132 and 136, respectively. Side panel 126 is attached to a top panel 138 by a fold line 140. Top panel 138 is attached to top end flaps 142 and 146 by fold lines 144 and 148, respectively. Side panel portion 150*b* is attached to a top panel 138 by a fold line 152. Side panel portion 150*b* is attached to side end flaps 154*b* and 158*b* by fold lines 156*b* and 160*b*, respectively. Side panel portion 150*a* is attached to side end flaps 154*a* and 158*a* by fold lines 156*a* and 160*a*, respectively. The carton may be provided with a handle 162 formed in side panel 126 and in one embodiment the handle is according to U.S. Pat. No. 5,106,014.

A tear line 168 is provided in the top panel 138, with the tear line 168 not extending along fold line 152 or along fold line 148. Tear line 168 defines and tightly connects a dispenser flap 178 to the top panel 138. A pull tab 180 is connected to the dispenser flap 178 by a fold line 182. The pull tab 180 is loosely attached to the top panel 138 by tear line portion 174. The dispenser flap when attached to the top panel of the carton covers a dispenser opening 179. The dispenser flap 178 and dispenser opening 179 have a generally circular configuration with the exception of the pull tab 182 and a pair of arcuate tear line portions 169, 171. The arcuate tear line portions 169, 171 are each positioned relative to one of the fold lines 148, 152 forming the corner 185 proximate to the location of the dispenser opening 179 in the top panel 138 of the carton 111. Importantly, the tear line 168 which defines the dispenser flap 178 and dispenser opening 178 is spaced from the adjacent fold lines 148, 152 and no portion of the tear line 168 intersects or is coincident with the fold lines 148, 152 according to one embodiment of this invention. The arcuate tear line portions 169, 171 define retaining flaps 173, 175, respectively, which extend into the dispenser opening 179 once the dispenser flap 178 is removed from the top panel 138 of the carton 111. As shown in FIGS. 9-10, the retaining flaps 173, 175 assist in retaining the container C positioned for removal from the carton 111 through the dispenser opening 179 until such time as a user extracts the container C through the dispenser opening 179. The retaining flaps 173, 175 initially project into the dispenser opening 179 and after removal of the container C, the retaining flaps 173, 175 may be partially deflected so that they are neither parallel nor perpendicular to the plane of the top panel 138 of the carton 111 thereby at least partially occluding the dispenser opening 179 to inhibit accidental removal or discharge of a container C from the carton 111 through the dispenser opening 179. The corner portion 185 of the top panel 138 remains after the dispenser flap 178 is removed and is generally positioned adjacent to the retaining flaps 173, 175 as shown in FIGS. 6-10.

In forming this blank 110 into a carton 111, the blank 110 is formed into a sleeve with the side panel portion 150*a* being glued to the side panel portion 150*b*. Containers C having a top portion can be loaded into the carton 111 with their top ends being adjacent to the top panel 138. The various end flaps 118, 122, 130, 134, 142, 146, 154, and 158 can be glued together to form the respective ends 181, 183 of the carton 111 and finish the erection of the loaded carton 111. It should be realized that this carton sleeve could be held together by locks rather than glue.

Figure 7:
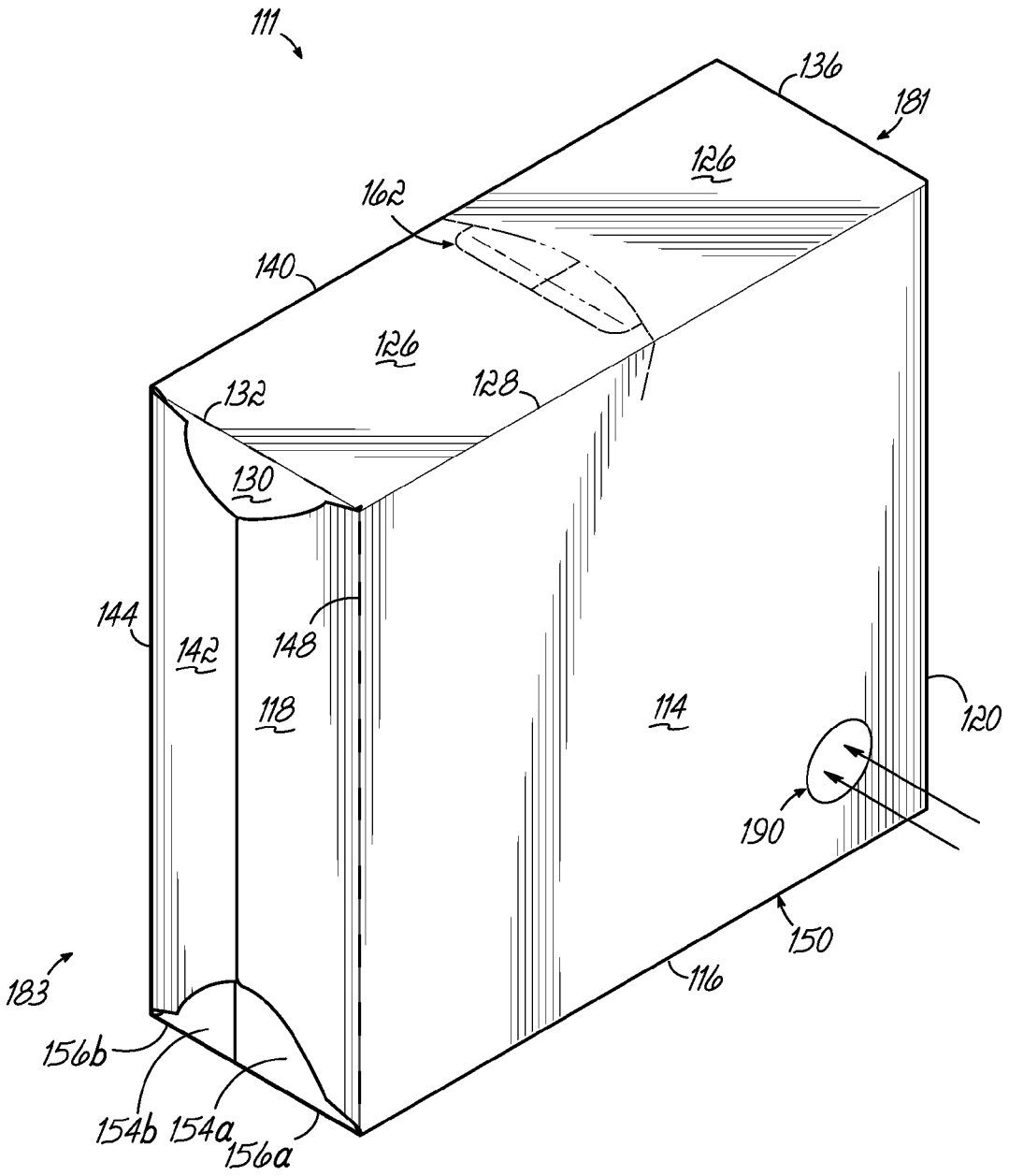
FIG. 7 is a perspective view of a carton formed from the carton blank of FIG. 6 showing a push hole.
Figure 8:
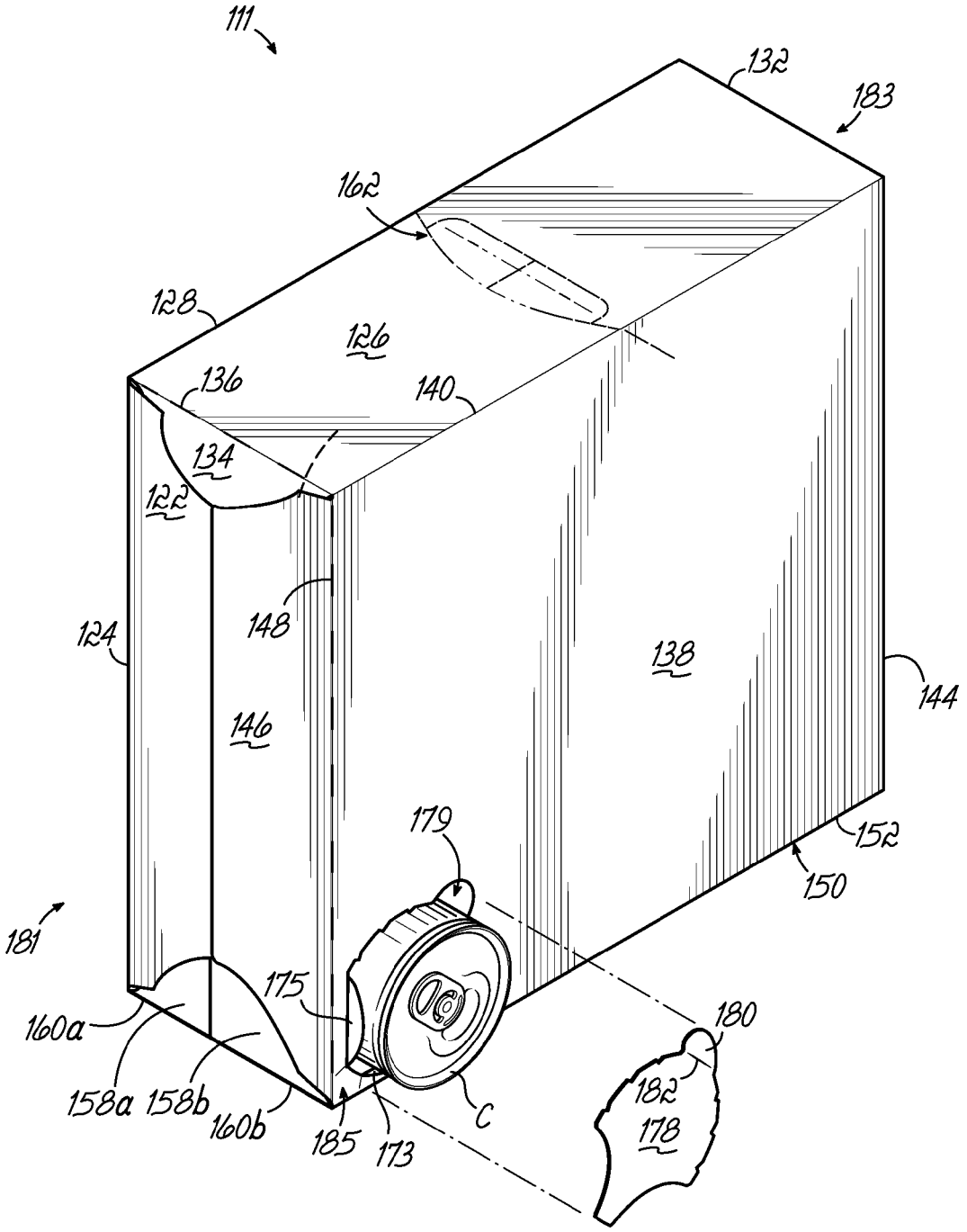
FIG. 8 is a view of the carton of FIG. 7 with a dispenser flap removed from the carton and a container exiting the carton through a dispenser opening.
Figure 9:
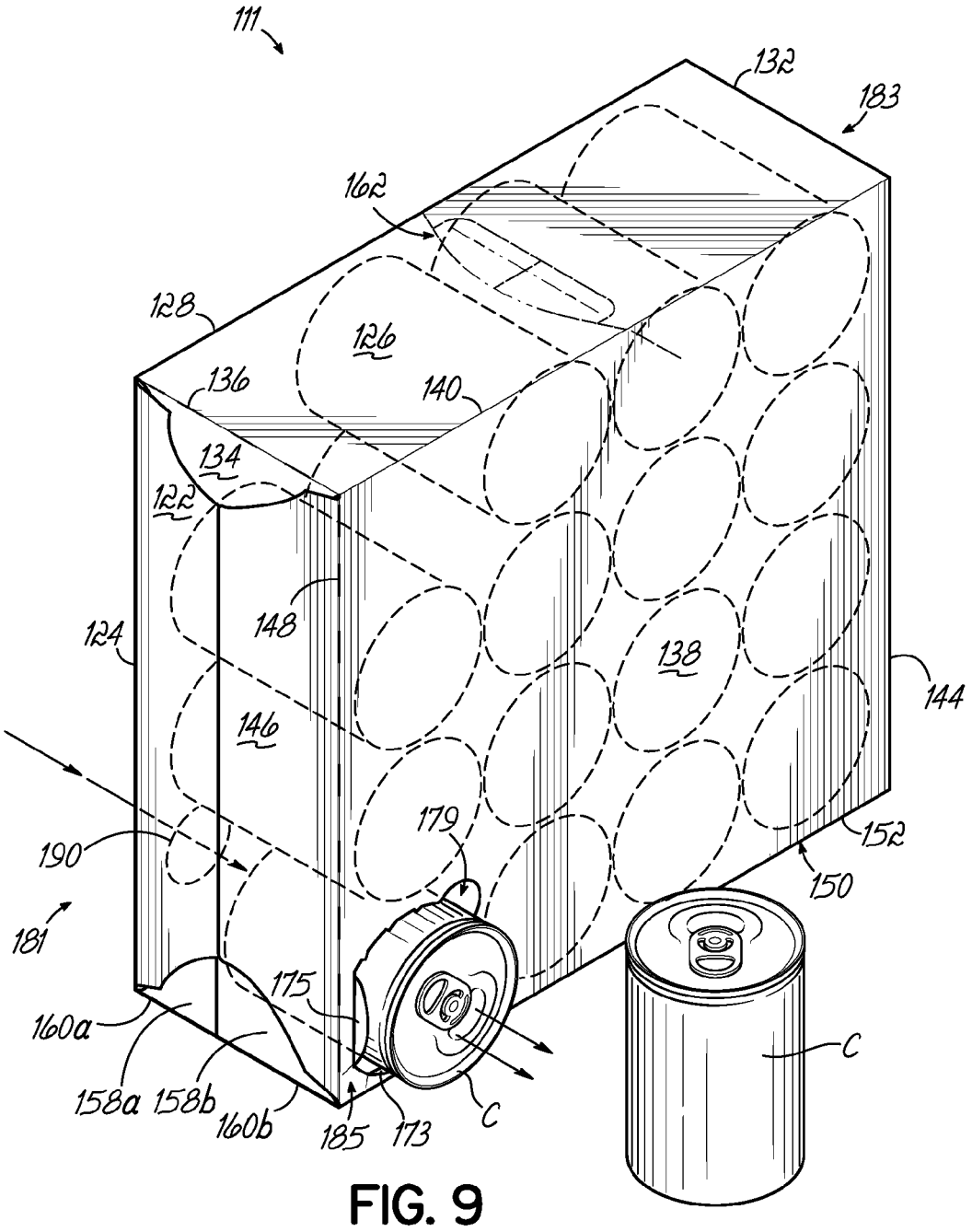
FIG. 9 is an end view of the carton of FIG. 8 with one container dispensed from the carton and another container being pushed out of the dispenser from a push hole by the user.

Containers C automatically roll into position for being dispensed by placing the carton 111 on the end 181 adjacent to the dispenser opening 179 or on the side 150 as illustrated in FIGS. 7-9. The dispenser flap 178 can be opened or removed while the carton 111 is resting on the side 150 or as shown in FIGS. 7-9 or when it has been placed on the end 181 adjacent to the dispenser flap 178. The dispenser flap 178 is removed by pushing pull tab 180 in and pulling out the pull tab 180. The dispensing flap 178 can be easily detached from the top panel 138 because of the tear line 168.

One feature of this embodiment of the blank 110 and associated carton 111 is a push hole 190 in bottom panel 114. The axis of the push hole 190 is bounded by the dispenser opening 179 and may be aligned with the axis of the dispenser opening 179 as shown in FIGS. 6-9. The push hole 190 may be initially covered or blocked by a cover tab (not shown) joined to the bottom panel 114 by one or more bridges formed between nicks in the paperboard or carton material. The push hole 190 is useful to provide access to a user to a longitudinal end of the can C positioned adjacent the dispenser opening 179 so that the can C may be at least partially pushed into the dispenser opening 179 as shown in FIGS. 8-9. At that point, the opposite longitudinal end of the container C projects from the dispenser opening 179 in the carton 111 for convenient grasping and removal of the container C from the carton 111.

A container C can then be removed through the resulting dispenser opening 179 by grasping the container C and pulling it along its longitudinal axis until it is removed from the carton 111. Another container C will then drop into place for removal through the dispenser opening. It will be observed that the containers C are placed in the carton 111 with their longitudinal axes normal to top panel 138 and bottom panel 114 with the one longitudinal end of the containers C being adjacent to the top panel 138 and the opposite longitudinal end adjacent to bottom panel 114.

It will be noticed that the dispenser flap 178 and dispenser opening 179 are basically circular, but are truncated where tear line 168 approaches fold lines 148, 152 and where it approaches corner 185 of the carton where fold lines 148, 152 intersect. Tear line 168 may be interrupted by fold line 182 connecting dispenser flap 178 with pull tab 180 which facilitates the pull tab exerting the leverage on the dispenser flap 178 for ease of removal.

It should be realized that the dispenser 178 and associated push hole 190 can be located in any corner of the carton 111 and dispensers could be located. In one embodiment, there is only one dispenser in order to preserve the integrity of the carton 111.

The dispenser flap 178 of this invention is resistant to accidental tearing by the weight of the adjacent container C by the provision of resistant tear line 168 connecting the dispenser flap 178 to the top panel 138 of the carton 111. The pull tab 180 that is loosely connected to the top panel 138 of the carton 111 has been provided so that it can be easily partially detached and provide the necessary leverage to remove the dispenser flap 178. The connection of the dispenser flap 178 can be constructed so the flap 178 can be completely removed.

Because the dispenser of this invention is located in the top panel, the dispenser flap can be easily removed for dispensing containers, but yet carried in its upright position by the handle without danger of the containers falling out of the carton.

The carton 111, with the container matrix suitably enclosed therein, is distributed through retail outlets to retail consumers with the dispenser 178 closed, i.e., with the dispenser flap integral with and not removed from the top panel 138. After purchase at a retail outlet, and in order to take the filled package or carton 111 home, the retail consumer can break away the carton's handle structure 162 so that the carton 111 can be carried by that handle structure. But the dispenser opening flap 178 is not removed from the carton 111 until use of the containers C stored within the carton 111 is desired by the retail customer.

When use of the containers C is desired, and as shown in FIGS. 7-9, the carton 111 may be stored on a shelf in a refrigerator or pantry. In order to remove the containers C one by one from the carton 111, the dispenser opening flap 178 is removed or torn away from the carton's top panel 138. With the carton 111 stored on its side panel 150 as shown in FIG. 7.

Containers C can be easily removed from the carton 111 while it is stored in that posture because the carton's dispenser opening 179 is located at the carton's corner 185. On the other hand, the carton 111 also can be stored on its end 181 with the containers C being easily removed from the carton 111 because in this storage position the carton's dispenser opening 179 is also located at the front edge.

Note particularly as illustrated in FIG. 8, that with the dispenser opening 179 open the carton 111 can be easily carried without the containers C remaining in the carton 111 falling out of the carton 111 as long as the carton's top and bottom panels 138, 114 are maintained generally perpendicular relative to ground. In other words, the structural integrity of the carton 111 is maintained at all of its four corners and particularly at that corner 185 from which the individual containers C are withdrawn as desired, because of the structural integrity of the corner 185 defined between the carton's adjacent panels.

From the above disclosure of the general principles of this invention and the preceding detailed description of various embodiments, those skilled in the art will readily comprehend the various modifications to which this invention is susceptible. Therefore, I desire to be limited only by the scope of the following claims and equivalents thereof.

I claim:

1. A package comprising:

a matrix of containers, each container of the matrix being of the same size and shape as every other container of the matrix, a longitudinal axis of each container being oriented generally parallel to the longitudinal axis of every other container in the matrix and the longitudinal axes of at least some of the containers being spaced from the longitudinal axes of others of the containers, and a carton within which the matrix of containers is positioned, the carton comprising:

opposed generally parallel first and second panels, the container axes of the container matrix being oriented generally normal to the first and second panels, and a dispenser defined in the first panel and including a dispenser opening, the dispenser opening being oriented on a single longitudinal axis oriented generally normal to the first panel, and the dispenser opening being sized to allow serial egress of each container in the container matrix out of the carton, thereby allowing each container whose longitudinal axis defined by first and second longitudinal ends and is oriented co-axially with the longitudinal axis of the dispenser to be removed out of the carton through the dispenser opening in the first panel, the first longitudinal end of the container being adjacent to the first panel;

at least on retaining flap projecting into the dispenser opening to inhibit egress of each container from the carton through the dispenser opening.

2. The package of claim 1 wherein the dispenser is located proximate a corner of and asymmetrically on the first panel.

3. The package of claim 2 wherein each of the first and second panels is generally rectangular in configuration, and each of the containers has a generally circular cross section, the first panel being a top panel and the second panel being a bottom panel, the carton further comprising:

two end panels, two side panels, and all panels together forming the carton.

4. The package of claim 3 further comprising:

a plurality of flaps extending from selected ones of the side, top and bottom panels, a first set of the plurality of flaps combining to form one of the end panels and a second set of the plurality of flaps combining to form another one of the end panels.

5. The package of claim 3 wherein a periphery of the dispenser opening is spaced from the adjacent end and side panels.

6. The package of claim 1 wherein the carton further comprises:

a dispenser flap removably closing the dispenser opening, the dispenser flap being removable by a user when removal of the containers from within the carton is desired.

7. The package of claim 5 wherein the dispenser flap is formed from the top panel, and the dispenser flap is at least partially defined by cut lines formed in the top panel.

8. The package of claim 6 further comprising:

a finger tab connected to the dispenser flap.

9. The package of claim 1 wherein the longitudinal axis of each of the containers is spaced from the longitudinal axis of each other container and the longitudinal axes of at least some of the containers is in a different position relative to the dispenser opening after one of the containers is removed from the carton.

10. The package of claim 1 further comprising:

a pair of the retaining flaps, one of which borders a panel adjacent to the first panel and the other of which borders a different panel also adjacent to the first panel of the carton.

11. The package of claim 10 further comprising:

a handle in a further different panel also adjacent to the first panel of the carton.

12. An enclosed carton for carrying a plurality of containers having a generally cylindrical shape, each said container being of the same size and shape as every other container in said plurality, each said container having a longitudinal axis being oriented parallel to and spaced from the longitudinal axis of every other container in said plurality when loaded into the carton, the carton comprising:

a bottom panel, a top panel, and foldably attached adjoining side panels and foldably attached end panels, and with said carton being designed so that the plurality of containers can be accommodated with their longitudinal axes being perpendicular to the planes of the top and bottom panels, said top panel having at least one corner, with each corner formed by the intersection of the fold lines between the top panel, an adjoining side panel, and an adjoining end panel;

a dispenser opening in the top panel for the removal of said containers one at a time, said dispenser opening being located adjacent to a corner of the top panel and asymmetrically on the top panel, said dispenser opening being closed by a dispenser flap that is coextensive with the dispenser opening, said dispenser flap not intersecting with the fold lines between said top panel, end panel and side panel, said tear line not intersecting the adjacent corner of the top panel, said dispenser flap being attached to a pull tab that is connected to the top panel for easy detachment by a user, said pull tab opening the dispenser flap when grasped and pulled with sufficient force to expose the dispenser opening and remove the dispensing flap from the carton; and at least one retaining flap projecting into the dispenser opening and adjacent one of the end panel and the side panel to inhibit removal of each container from the carton through the dispenser opening.

13. The carton of claim 12 further comprising:

a fold line between said pull tab and said dispenser flap.

14. The carton of claim 12 wherein the dispenser flap does not include the corner of the top panel proximate the intersection of the top panel, the side panel and the end panel.

15. A carton blank adapted to be formed into a carton for containing a plurality of generally cylindrical containers each having a longitudinal axis in which the longitudinal axis of each container is spaced from the longitudinal axis of each other container, the carton blank comprising:

a plurality of serially connected panels;

a plurality of panel fold lines each joining an adjacent pair of the panels together;

a plurality of flaps each extending from an end of one of the panels;

a plurality of flap fold lines each joining one of the flaps to an associated one of the panels such that a first set of the plurality of flaps are folded about the respective flap fold lines to form a first end panel of the carton erected from the carton blank and a second set of the plurality of flaps are folded about the respective flap fold lines to form a second end panel of the carton;

a dispenser flap formed in one of the panels adjacent to a corner of the one of the panels formed by an intersection of one of the panel fold lines and one of the flap fold lines;

a tear line in the one of the panels, the tear line being adapted to be torn to at least partially remove the dispenser flap from the one of the panels to expose a dispenser opening through which one of the containers may be removed from the carton erected from the carton blank;

wherein the longitudinal axes of the containers are generally perpendicular to the dispenser flap when the containers are contained in the carton erected from the carton blank; and at least one retaining flap formed in the one of the panels adjacent to the dispenser flap and one of the one of the panel fold lines and the one of the flap fold lines to inhibit removal of the containers through the dispenser opening in the carton erected from the carton blank.

16. The carton blank of claim 15 further comprising:

a handle formed in another one of the panels adjacent to the one of the panels.

17. The carton blank of claim 15 further comprising:

a pair of the retaining flaps oriented generally perpendicularly to each other.

18. The carton blank of claim 15 wherein the dispenser flap does not include the corner and is positioned asymmetrically on the one of the panels.

19. The carton blank of claim 15 wherein the at least one retaining flap has a generally arcuate terminal edge.

20. The carton blank of claim 15 further comprising:

a pull tab coupled to the dispenser flap by which a user may tear the dispenser flap from the one of the panels to expose the dispenser opening.

21. The carton of claim 12 wherein the longitudinal axis of each of the containers is spaced from the longitudinal axis of each other container and the longitudinal axes of at least some of the containers is in a different position relative to the dispenser opening after one of the containers is removed from the carton.

* * * * *